United States Patent [19]

Lin

[11] 4,173,443

[45] Nov. 6, 1979

[54] SPRAY SPINNING NOZZLE HAVING CONVERGENT GASEOUS JETS

[75] Inventor: Victor J. Lin, Berkeley Heights, N.J.

[73] Assignee: Celanese Corporation, New York, N.Y.

[21] Appl. No.: 802,342

[22] Filed: Jun. 1, 1977

[51] Int. Cl.[2] ..... B29D 31/00

[52] U.S. Cl. ..... 425/66; 425/82.1; 425/83.1; 425/725; 57/204

[58] Field of Search ..... 425/66, 80–83, 425/72 S, 378 S, 404, 445; 65/12, 16; 264/12, 210 F; 57/55.5, 34 AT

[56] References Cited

U.S. PATENT DOCUMENTS

| | | | |
|---|---|---|---|
| 2,036,838 | 4/1936 | Taylor | 425/66 X |
| 2,317,895 | 4/1943 | Drill | 425/83 X |
| 2,510,135 | 6/1950 | Pedlow et al. | 425/72 S |
| 2,692,220 | 10/1954 | Labino | 425/82 X |
| 2,697,056 | 12/1954 | Schwartz | 425/82 X |
| 2,859,506 | 11/1958 | Slayter | 425/82 X |
| 2,886,877 | 5/1959 | Frickert et al. | 425/82 X |
| 3,009,205 | 11/1961 | Monson et al. | 264/12 |
| 3,418,095 | 12/1968 | Kleist | 264/12 X |
| 3,824,052 | 7/1974 | Fowler | 425/83 |
| 3,836,346 | 9/1974 | Stalego | 425/72 S X |
| 4,042,653 | 8/1977 | Beyn | 264/12 X |
| 4,047,861 | 9/1977 | Balaz | 264/12 X |
| 4,070,173 | 1/1978 | Levecque et al. | 264/12 X |

FOREIGN PATENT DOCUMENTS

| | | | |
|---|---|---|---|
| 117321 | 7/1918 | United Kingdom | 264/12 |

*Primary Examiner*—Robert L. Spicer, Jr.
*Attorney, Agent, or Firm*—Marvin Bressler

[57] ABSTRACT

A spray spinning nozzle for producing a substantially continuous filament from a molten synthetic resinous material includes a nozzle with a removable orifice from which a filament of molten material is emitted and a gas attenuation assembly which is laterally removable from the nozzle. The attenuation assembly includes at least three gas jets spaced about and radially close to the nozzle axis for emitting high velocity jets which converge upon and contact the filament at a point along the axis in front of the orifice. Drag forces produced by the gas jets attenuate the filament to a thin diameter.

10 Claims, 9 Drawing Figures

Fig. 1
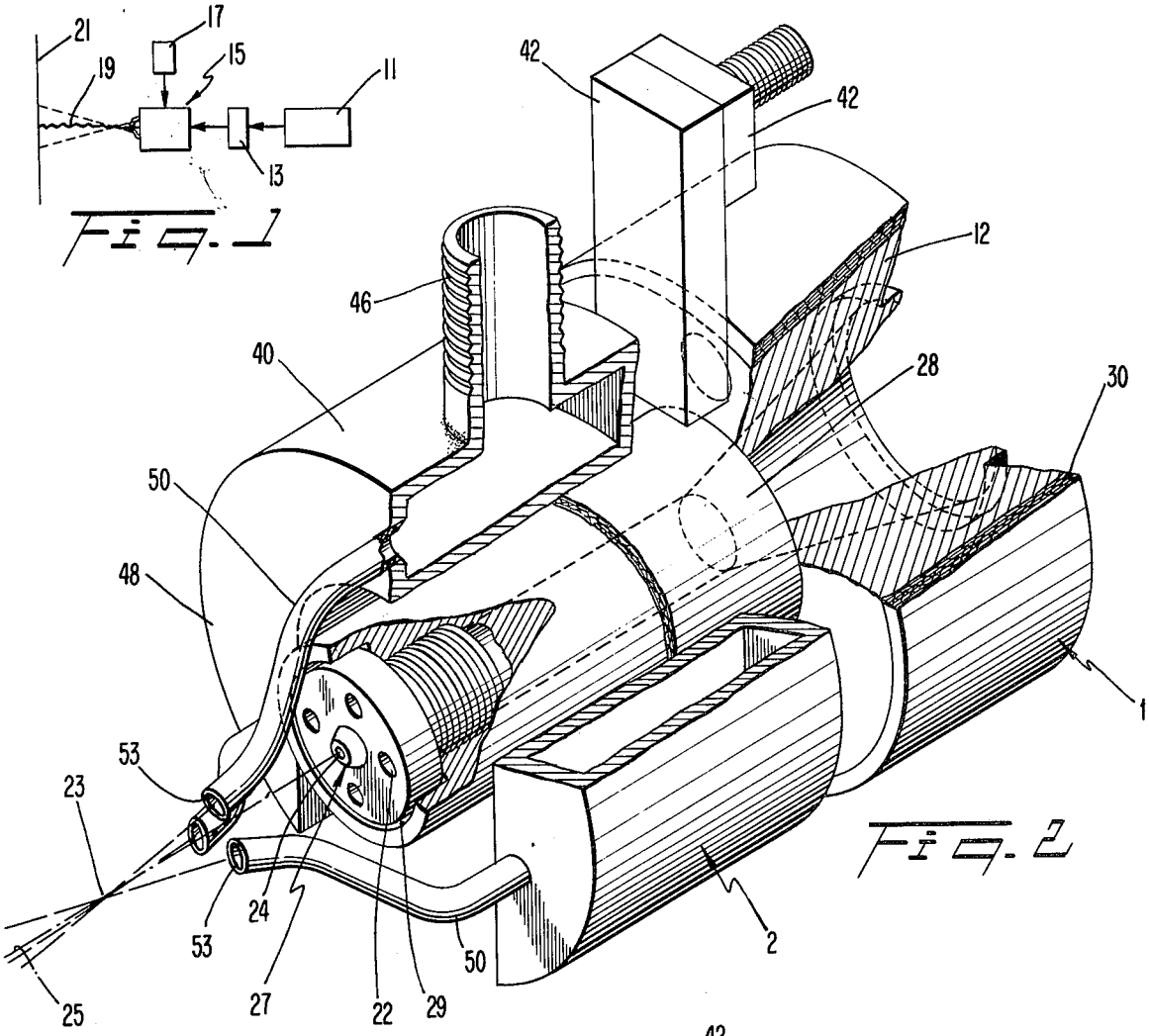
Fig. 2
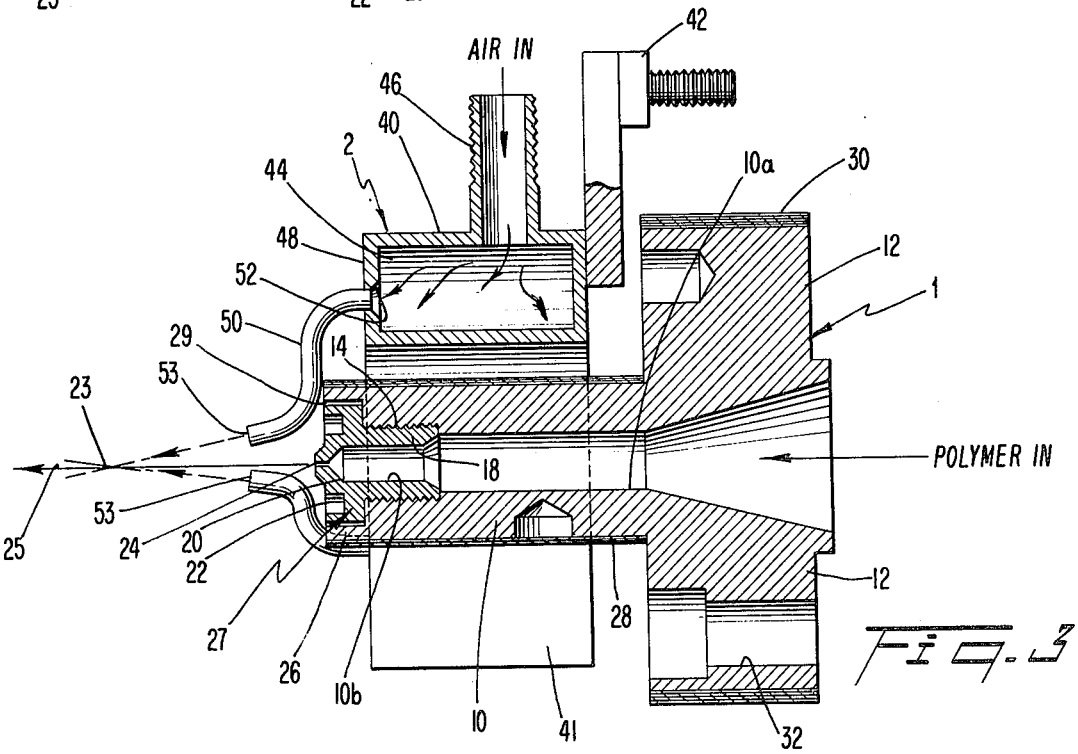
Fig. 3

SPRAY SPINNING NOZZLE HAVING CONVERGENT GASEOUS JETS

CROSS REFERENCE TO RELATED APPLICATION

Filed concurrently herewith is a related application also assigned to the assignee of the present invention, by Donal McNally entitled "Spray Spinning Nozzle Using Parallel Jet Flow", the entire content of which is incorporated herein by this reference thereto, Ser. No. 802,341, filed June 1, 1977.

BACKGROUND OF THE INVENTION

This invention relates generally to the production of filamentary material and more particularly to a novel spray spinning nozzle for spinning molten synthetic resinous material to form a nonwoven structure.

Various apparatus has been developed in the past to create an integrated system for forming a fibrous assembly, such as a nonwoven fabric or the like, directly from a molten synthetic resinous material. Typically, such an apparatus may use an extruder in which a synthetic resinous polymeric material is plasticated under the influence of heat and pressure to form a quantity of molten material which can then be forced through a nozzle orifice as a continuous liquid filament. Each of a plurality of high velocity gaseous jets is directed along the freshly extruded filament at a shallow angle to create a drag force for attenuating the filament which is then carried along by the attenuating gaseous jets and deposited on a collection surface to form a nonwoven structure. Such a device in the past has been known as spray spinning apparatus because the filamentary material appears to be sprayed against the collection surface.

The attenuating gaseous jets contribute to filament cooling in addition to both attenuating and conveying the filament to the collection surface. Since the filament of polymeric material is still in a somewhat molten or tacky stage as it strikes the collection surface, some sticking together occurs at each point where filament contacts itself. Also, the filament may loop about and stick to itself.

One such spray spinning apparatus is shown in U.S. Pat. No. 3,849,040 which is assigned to the assignee of the present patent application. This patent shows a stream of filamentary material emanating from a nozzle. A pair of elongated attenuating gas jets, each with a rectangular cross section, are placed on either side of the nozzle. The gas jet outlets are both in the same plane perpendicular to the nozzle axis, are positioned forwardly of the nozzle orifice and the gas jets therefrom intersect at a point offset from the nozzle axis in the plane of the nozzle axis. The axial component of the drag forces produced on the filament by the gas jets attenuate the filament. Great care must be taken to control the geometry of the gas jets to provide a proper distribution in the collected filament.

One disadvantage of this system is that the angles of the gas jets require adjustment when the gas pressure or polymer flow rate is changed. Thus, careful and time-consuming control of the gas pressure and gas jet angles is required.

The molten polymer and the attenuating gas do not flow through the same nozzle. The gas jets are separated from the nozzle orifice by an insulating means such as an air space. As a result, the gas jets produce a low pressure area near the nozzle orifice which induces a flow of ambient air past the nozzle. This induced flow tends to convectively cool the nozzle and to cause the molten material to harden and obstruct the orifice: known as nozzle freeze-up.

Another disadvantage of such apparatus relates to the difficulty in controlling the spray pattern. The filament seems to wander causing an unduly broad and unfocused spray pattern. Accordingly, positioning of spray spinning nozzle for product uniformity is difficult.

In the past it has been necessary to use high throughput rates of polymeric material through the nozzle to reduce nozzle freeze-up. This produces a thicker filament, requires higher gas supply pressure to obtain higher momentum in the attenuating gas jets, and requires the distance between the nozzle orifice and the collection surface to be greater than desired. As a result of these higher operating parameters, the nonwoven structures produced by present spray spinning apparatus have not been entirely satisfactory. The filament is relatively thick and also includes quantities of "shot" which is solid debris or beads of non-attenuated material which increase cost and weight of a product and undesirably affect the feel of the nonwoven product. Unformity of filament thickness and spray pattern has been difficult to attain and maintain. Collection can be difficult and attenuation efficiency has been low. Under these conditions overall operation can be difficult.

During start-up of a horizontal spray spinning system, the plasticated synthetic resinous material passes through the nozzle orifice and is allowed to drop without attenuation. When time-wise steady temperature and flow conditions are obtained, the gas jets are brought into operation to attenuate and convey the filament to the collection surface.

Also, during operation of the spray spinning apparatus, aberrant performance of a spray spinning nozzle may necessitate abrupt interruption of the action of the gas jets to avoid ruining a product being manufactured.

When the air manifold can only be removed axially from the nozzle through which the synthetic resinous material is extruded, removal of the manifold is accompanied by depositing material thereon. The deposited material may interfere with actual assembly of the manifold on the nozzle and may accumulate in a sufficient quantity to interfere with actual operation of the nozzle.

Should the nozzle discharge polymeric material upstream of the gaseous jet exhaust, then the starting problem is further exacerbated. In addition, the potential for polymer accumulation in the event of malfunction during operation is substantially heightened. Where the gas manifold is annular, the material accumulation is generally a problem.

Another significant problem with spray spinning nozzles relates to the manner in which orifice blockage can be removed. Generally, substantial disassembly of the nozzle is required. In fact, in many instances, the entire spray spinning nozzle must be removed from the source of polymeric material and disassembled. With a small diameter extrusion orifice, the likelihood of blockage and freeze-up is materially increased.

Accordingly, it will be apparent to those skilled in the art that there continues to exist a need for a spray spinning nozzle assembly which overcomes problems of the type discussed above.

SUMMARY OF THE INVENTION

A spray spinning nozzle in accordance with this invention includes a nozzle assembly for receiving synthetic resinous polymeric material from a source thereof. The nozzle assembly includes a fluid passage with an opening in the distal end communicating with the passage. The opening is adapted to receive an orifice body having an extrusion orifice therethrough.

In order to attenuate a filament of synthetic resinous material extruded through the orifice and to convey the attenuated filament to a collection surface, an assembly for directing gaseous jets in the general direction of the filament is provided. This assembly may include a manifold for receiving and distributing pressurized gas to a plurality of jet forming conduits.

The jet forming conduits preferably extend in cantilever fashion from the manifold to a position downstream of the extrusion orifice and eliminate an annular member around the orifice which might be fouled by synthetic resinous material during, for example, starting. Each jet forming conduit has a discharge opening positioned at a common radius from the axis of the extrusion orifice and discharges a gaseous jet at a common angle with respect to the axis. In this manner, the gaseous jets provide a balanced gaseous flow around the filament. Moreover, by locating the discharge openings downstream of the extrusion orifice, the likelihood of convective cooling and material freeze-up in the orifice is diminished since high velocity jets do not traverse the orifice body.

The manifold, with the cantilevered jet forming conduits, is adapted to be laterally movable relative to the nozzle assembly and the orifice body. In this fashion, the manifold and the gaseous jets can be moved into operative relationship with the filament when the polymeric material attains uniform conditions at start-up. Moreover, the manifold and the gaseous jets can be quickly moved out of operative relationship relative to the filament in the event there is a malfunction in the nozzle assembly, orifice body or an upstream supply device.

In order to adjust the direction of the filament being spray spun, the manifold is mounted for translation in each of three orthogonal directions as well as for rotation about each of two perpendicular axes, each of which is also perpendicular to the nozzle axis.

By arranging the jet forming conduits so that no conduit is positioned vertically below the extrusion orifice, the potential that any polymeric material can collect on any one of the conduits is severely diminshed.

With the extrusion orifice positioned in a removable orifice body, the delay in eliminating a plugged orifice is also reduced. This reduction is effected by the ability to quickly remove and replace the orifice body without completely disassembling and reassembling the spray spinning nozzle.

To enable the spray spinning nozzle to operate at low polymeric material throughput rates, the jet forming conduits may include serpentine bends to position the discharge openings thereof radially close to the nozzle orifice axis as well as axially close to the nozzle orifice exit plane. In this manner, the gaseous jets are positioned sufficiently close to the orifice to pick up a filament which emanates from the orifice at a comparatively low velocity associated with a low throughput rate.

The nozzle assembly is preferably provided with heating means to guard against heat loss by convective cooling and to maintain the nozzle assembly and orifice body at a suitable temperature. Preferably, the temperature is maintained at a level in the range between the melting temperature of the material being extruded into a filament and that temperature at which the material becomes so degraded as to be incapable of forming a substantially continuous filament. This temperature range resists any external influences which might otherwise tend to cause nozzle freeze-up.

In one embodiment of the spray spinning nozzle, the nozzle assembly has a polymeric material passage which is straight and extends to the orifice body. The manifold has a C-shaped cross-sectional configuration which is adapted to move laterally with respect to the axis of the extrusion nozzle into a saddle-like relationship to the nozzle assembly. In this embodiment, the manifold configuration permits a straight material passage which reduces the likelihood of material degradation during traversal of the nozzle assembly.

The orifice body is preferably mounted in an opening at the distal end of the nozzle assembly so as to be essentially flush with the distal end thereby minimizing heat loss by convective cooling. Moreover, the end portion of the orifice body is radially spaced from the surrounding nozzle assembly and defines an annular recess which facilitates removal of the orifice body in the event of thermal expansion.

In a second embodiment of the spray spinning nozzle, the nozzle assembly includes an offset adapter having a polymeric material passage therethrough which radially displaces the orifice body from an inlet. The manifold may have an easily fabricated cylindrical configuration with the jet forming conduits extending therefrom. The jet forming conduits traverse the distal end of the offset adapter and are positioned around a filament emanating therefrom.

BRIEF DESCRIPTION OF THE DRAWINGS

Other features and advantages of this invention will become apparent from the following description of the preferred embodiments thereof taken in conjunction with the following drawings wherein:

FIG. 1 is a schematic illustration of an integrated spray spinning assembly in which a spray spinning nozzle according to the invention may advantageously be employed;

FIG. 2 is an enlarged perspective view of one embodiment of the spray spinning nozzle and its associated attenuating assembly with portions broken away for the sake of clarity;

FIG. 3 is a longitudinal view in partial cross section of the nozzle and attenuating assembly shown in FIG. 2;

DESCRIPTION OF THE PREFERRED EMBODIMENTS

Figure 4:
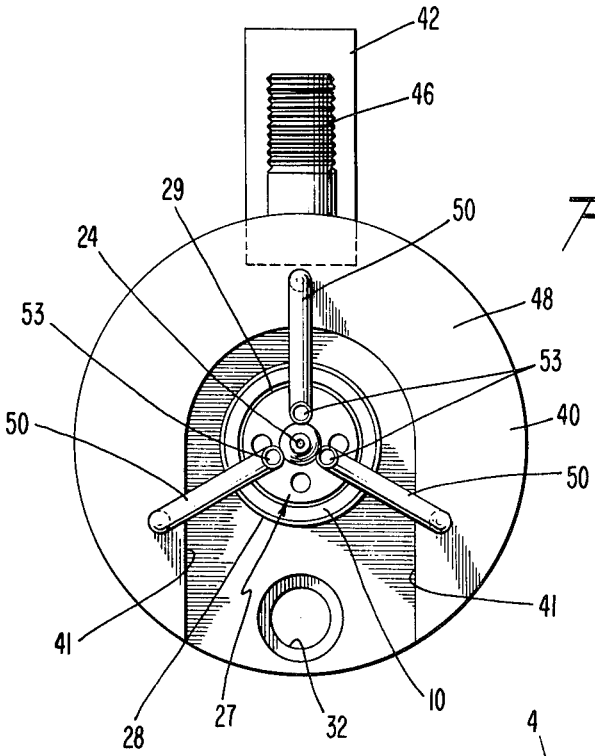
FIG. 4 is a front elevational view of the nozzle and attenuating assembly shown in FIG. 2.

In reference to FIG. 1, a spray spinning system in accordance with the present invention includes a source of molten synthetic resinous polymeric material which may include a suitable conventional extruder 11 for plasticating particulate synthetic resinous material under appropriate conditions of heat and pressure. The plasticated or melted material may then be advanced to a suitable conventional melt pump 13 where the material may be further pressurized and delivered to a horizontally oriented spray spinning nozzle assembly 15 constructed in accordance with this invention.

Also communicating with spray spinning nozzle assembly 15 is a suitable source 17 of pressurized gaseous fluid, such as pressurized ambient air. The spray spinning nozzle assembly 15 shapes the melted material into a filament 19 and directs a gaseous current of pressurized air jets toward the filament to attenuate the filament, cool the filament, orient the material of the filament and convey the filament to a suitable conventional collection surface 21.

Turning now to FIG. 2, the spray spinning nozzle includes an extrusion nozzle (generally identified as 1) from which a substantially continuous filament of molten polymeric material is emitted. An assembly (generally designated as 2) is provided for emitting converging symmetrically aligned gas jets which contact the filament at a point 23 along an axis 25 of an orifice body 27. The point 23 is also in front of the orifice body 27 so that the gas jets attenuate the molten polymeric filament to a thin diameter. The filament may then be carried along by the gas jets and onto the collection surface to form a three-dimensional nonwoven structure.

The nozzle assembly 1 has a generally cylindrical body 10 (see FIG. 3) with a mounting head 12 connected to one end thereof for mounting the nozzle assembly to the melt pump or the extrusion apparatus. The body 10 receives polymeric material from the extruder and advances the material to the orifice body 27. The nozzle assembly 1 may have a generally axial fluid passage **10*a* extending throughout its length which includes a generally cylindrical portion and, in the mounting head 12, a frustoconical portion. The frustoconical portion tapers convergently toward the nozzle centerline. The nozzle centerline is coaxial with the axis 25 of the orifice body 27**.

At the distal end of the body 10, there is a coaxial cylindrical recess or opening 14 for accommodating the orifice body 27. The orifice body 27 includes a body section 18 having a diameter greater than fluid passage **10*a* of the nozzle body 10. The discharge end of the orifice body 27 has a head 20 in which are disposed four axial sockets 22 that accommodate a spanner wrench. The spanner wrench may be used to tighten or remove the orifice body 27 from the nozzle body 10 without disassembling the entire nozzle assembly 1. The body section 18 is externally threaded and has a diameter sufficient to accommodate threads of a size and strength to hold the orifice body 27 securely inside the end of the body 10. The diameter of the recess 14 is correspondingly chosen to accept the body section 18** and is internally threaded.

The orifice body 27 has a central passage **10*b* which tapers in two steps to an extrusion orifice 24 having a diameter of approximately 0.016 inches and a length of approximately 0.064 inches. The discharge end of the extrusion orifice 24 may project slightly beyond the plane of the head 20. An annular coaxial flange 26 projects axially from the periphery of nozzle body 10 and completely surrounds the head 20. The outside diameter of the head 20 is less than the inside diameter of the flange 26 so that an annular air space 29 is provided between the head 20 and the flange 26. This annular air space 29 prevents binding between the head 20 and the flange 26 at high temperatures. The head 20 and the flange 26** terminate in the same plane and are essentially flush with one another.

The body 10 and the mounting head 12 are each completely surrounded by suitable conventional heating means 28, 30 which provide conductive heat transfer to the body 10 and the head 12, respectively. The heating means 28, 30 maintain the nozzle body 10 within a predetermined temperature range. This temperature range is preferably between the melting temperature of the particular polymeric material and that temperature at which the polymeric material becomes so degraded as to be incapable of forming a substantially continuous filament so that any tendency to freeze-up is substantially diminished.

The attenuating apparatus 2 includes a hollow manifold 40 having a C-shaped cross-sectional configuration (see FIG. 4). The manifold 40 is suspended about the nozzle body 10 in a saddle-like relationship by a device 42. Preferably, the device 42 is adapted for moving the manifold 40 axially with respect to the nozzle body 10, for moving the manifold 40 transversely of the axis 25 in a horizontal plane, and for moving the manifold 40 traversely of the axis 25 in a vertical plane. In addition, the device 42 may rotate the manifold 40 about a vertical axis perpendicular to the nozzle axis 25 and may rotate the manifold 40 about a horizontal axis perpendicular to the nozzle axis 25. With the foregoing adjustability, the manifold 40 can be adjusted as required to direct the filament extruded through the orifice 27 and to accommodate maldistribution of the filament material issuing from the orifice body 27. A suitable means for laterally displacing the manifold 40 is connected to the device 42 to which the nozzle body 10 is connected so as to support the device 42.

The C-shaped cross section of manifold 40 allows it to be easily positioned laterally relative to the body 10. The manifold 40 defines a plenum chamber 44 (see FIG. 3) into which pressurized attenuating gas (preferably ambient air) is directed through a coupling 46 from the supply apparatus 17 (see FIG. 1). As seen in FIG. 4, the inside surface 41 of the C-shaped manifold 40 is radially spaced apart from the peripheral surface of the body 10 and the heating means 28 therearound.

Extending in cantilever fashion from a forward facing surface 48 of the manifold 40 are three gas conduits 50 each of which communicate with the plenum chamber 44 (see FIG. 3) to deliver a corresponding jet of attenuating gas to a location downstream of the extrusion orifice 24. The gas conduits 50 communicate with the plenum 44 through corresponding holes 52 in the forward facing surface 48. The inside of each hole 52 may be chamfered to facilitate air flow. Each gas conduit 50 may be fabricated from a reasonably stiff material such as stainless steel, which can be bent into a desired contour and will maintain that contour without external support. The discharge opening 53 of each gas conduit 50 is aligned in a plane perpendicular to the axis 25 of the orifice body 27. In addition, the discharge opening 53 are disposed at a common radius from the nozzle axis (see FIG. 4) and may be equiangularly positioned. Each gas conduit 50 is directed (see FIG. 3) to provide a gas jet which converges upon the nozzle axis 25 at an angle less than 45°. Preferably the angle is in the range of 5° to 30°. The gas jets intersect each other at the point 23 downstream of the extrusion orifice 24.

A minimum of three gas conduits 50 is required to provide a flow that is circumferentially balanced around the filament. Any number of gas conduits greater than three may be used so long as the gas conduit discharge openings 53 are coplanar and angularly spaced at a common radial distance from the axis 25. It will be observed from FIG. 4 that no discharge opening 53 is positioned vertically under the extrusion orifice 24. In this manner, the molten filament is unlikely to fall upon and foul any of the discharge openings 53.

Because the present invention contemplates operating at a low material throughput rate, it is desirable to have the gas jets contact the molten filament quickly and close to extrusion orifice 24. This result is accomplished by positioning the discharge openings 53 of the gas conduits radially close to the axis 25 and axially close to the extrusion orifice 24. The serpentine or S-shaped configuration of the gas conduits 50 (see FIG. 3) makes possible the appropriate positioning of the discharge openings 53.

The radius of the discharge openings from the axis 25 preferably is no smaller than about 0.25 inch and preferably is no greater than about 1.0 inch. Smaller radii would be likely to interfere with the filament as it leaves the orifice 24 as the filament does not always follow a straight path. Larger radii would be undesirable as the gas jets become too remote and their effectiveness diminishes requiring greater flow rates and higher gas pressures.

It will be observed from FIG. 3 that an air space does exist between the body 10 and the inside surface 41 of the manifold 40. The gas jets emanating from the discharge openings 53 will induce a certain amount of air flow through this space. This induced air flow, however, will not appreciably cool the body 10 because it is surrounded by the heater means 28. Furthermore, because the diameter of body 10 is reasonably large, most of this induced air flow will bypass the vicinity of the extrusion orifice 24 so that convective cooling will be minimized.

In operation (see FIG. 3), a quantity of molten polymeric material enters the nozzle assembly 1 through the converging section of the nozzle passage **10*a* in the head 12 and proceeds to the orifice body 27 where it converges in two steps and is shaped by the extrusion orifice 24 into a filament. Pressurized attenuating gas enters the intake 46, circulates in the plenum chamber 44, enters each gas conduit 50 through a corresponding chamfered hole 52 and exhausts from the corresponding discharge opening 53 as a plurality of substantially equiangularly spaced gas jets in front of the extrusion orifice 24. The jets intersect each other at the point 23 on the axis 25. As the filament generally follows the axis 25**, the gas jets also impinge upon the freshly extruded filament.

Drag forces exerted on the filament by the jets attenuate the freshly extruded filament to a fine diameter. The filament is carried along by a combination of the gas jets and entrained air and then deposited on the collection surface to form a nonwoven structure.

During starting, as well as during operation, the manifold 40 can be moved laterally into and out of operative position with respect to the nozzle assembly 1. Accordingly, the influence of gas jets on the filament can be interrupted as necessary. Moreover, the positioning of the discharge openings 53 is such that the orifice body 27 is isolated from convective cooling effects. The removable orifice body permits rapid return to operation as it can be rapidly changed in the event of orifice blockage.

Figure 5:
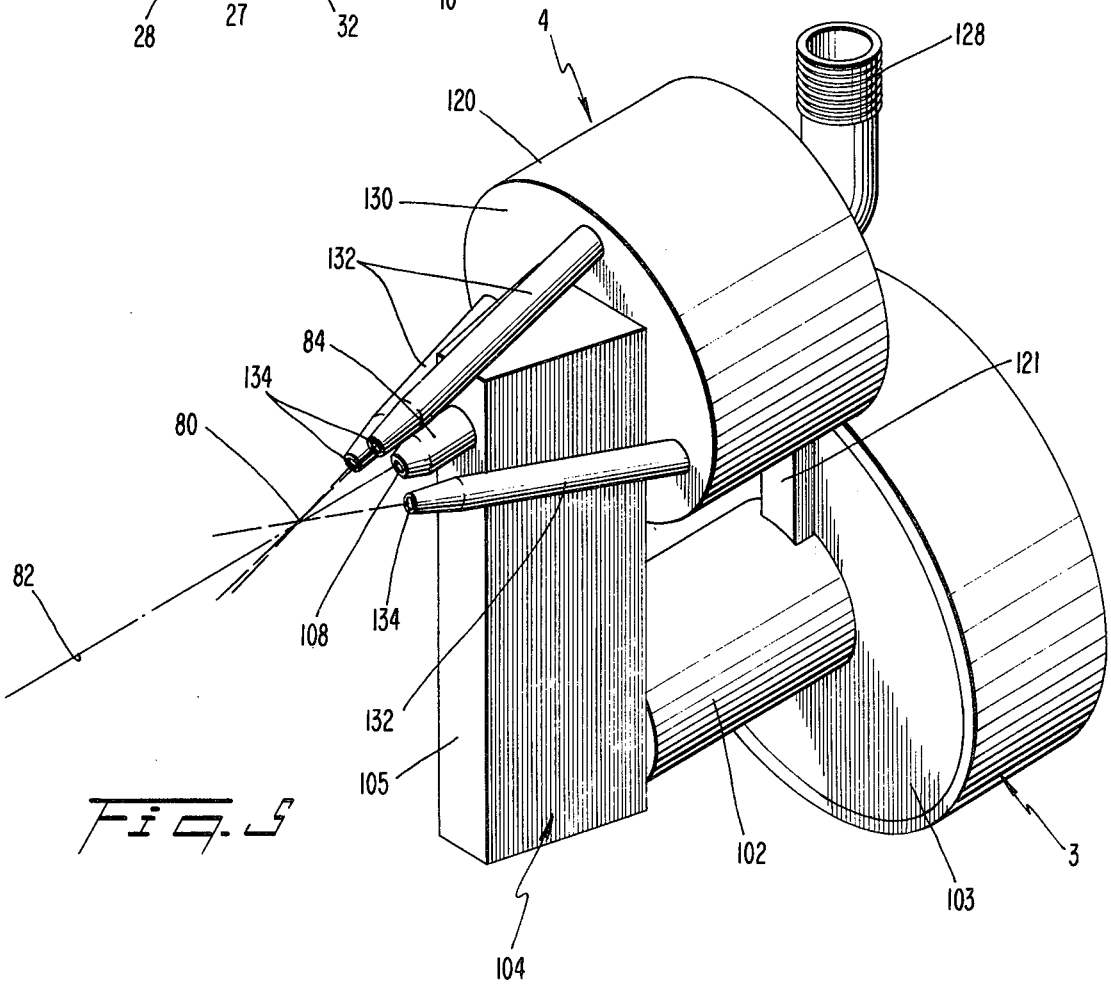
FIG. 5 is an enlarged perspective view of a second embodiment of the spray spinning nozzle and its associated attenuating assembly.

Turning now to FIG. 5, there is shown a second embodiment of the present invention which includes an offset extrusion nozzle assembly (generally identified as 3) from which a continuous stream of molten polymeric material is emitted. An attenuation gas assembly (generally designated as 4) emits at least three symmetrically aligned converging gas jets which contact the filament at a point 80 along the axis 82 of an orifice body 84. The point 80 is downstream of the orifice body 84 to facilitate attenuation of the molten stream to a thin filament. The filament may be carried along by the gas jets in the same manner as described above in connection with the first embodiment.

The offset nozzle assembly 3 includes (see FIG. 6) a generally cylindrical mounting head 100 for connecting the assembly to a source of molten polymeric material. A portion 102 of an L-shaped nozzle offset adapter 104 extends axially from a forward facing surface 103 of the mounting head 100. The nozzle offset adapter 104 includes a leg 105 extending generally perpendicularly from the distal end of the portion 102. The mounting head 100 has a rearwardly facing flange 86 (see FIG. 6) for positioning the nozzle assembly 3 relative to the supply of extrudable material. The nozzle assembly 3 (see FIG. 6) may have a fluid passage 106 extending throughout its length and including generally cylindrical portions and, in the mounting head 100, a generally frustoconical portion 107. The frustoconical surface portion is positioned in the mounting head 100 and converges from the rearward facing flange 86 to the generally cylindrical fluid passage. The fluid passage 106 includes two bends, 109, 111, each of which turns the polymeric material through an angle. The bends 109, 111 enable the axis 90 of a discharge opening 88 to be offset from the axis 92 of the adapter portion 102. Thus, the offset fluid passage 106 in the offset adapter 104 permits a polymeric material stream to be extruded along the axis 90 which is parallel to but radially displaced from the axis 92 of nozzle body portion 102.

An extrusion orifice 108 is disposed in the orifice body 84 which is mounted at the distal end of the offset adapter leg 105 and in the forward facing surface thereof. The orifice body 84 is removable and is aligned such that its axis 90 is coaxial with axis 90 of the opening 88 and parallel to the axis 92 of the portion 102.

Figure 6:
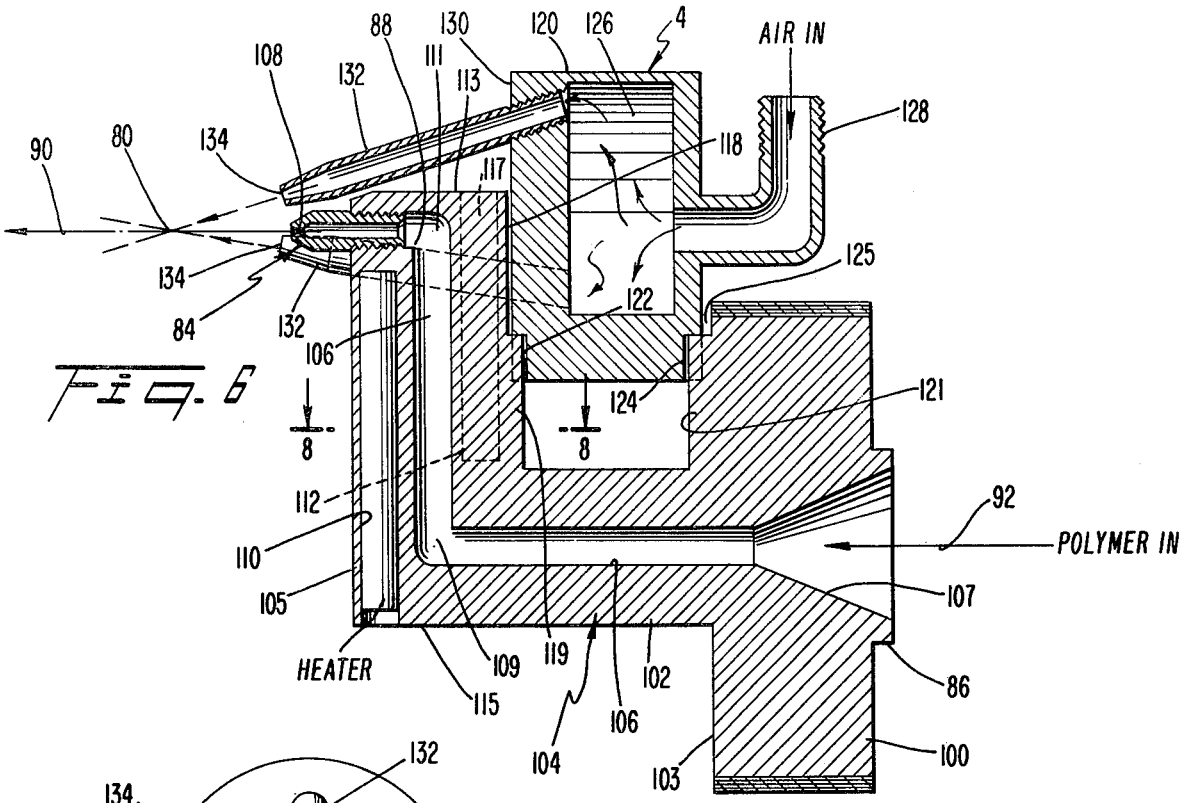
FIG. 6 is a longitudinal view in partial cross section of the nozzle and attenuating assembly shown in FIG. 5.
Figure 8:
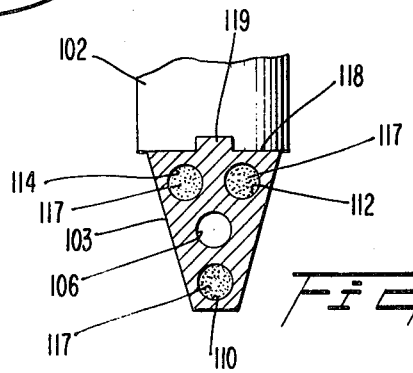
FIG. 8 is a partial cross-sectional view taken along the line 8—8 of FIG. 6.

The leg 105 of the nozzle offset adapter 104 has a trapazoidal cross section and includes a plurality of parallel cylindrical recesses 110, 112, 114 (see FIG. 8) for accommodating a corresponding plurality of heater means 117. In FIG. 6, two recesses 112, 114 extend from the radially remote surface 113 of adapter leg 105 toward the portion 102 and are generally parallel to and rearward of fluid passage 106. The recess 110 extends from the bottom surface 115 of the adapter leg 105 away from the axis 92 in a direction parallel to and forward of fluid passage 106. The recesses 110, 112, 114 provide pockets surrounding the fluid passage 106 into which a corresponding plurality of heating means may be placed to provide conductive heat transfer to the leg 105. The heat transfer maintains the leg within the predetermined temperature range discussed above in connection with the first embodiment. The heater means may comprise cylindrical cartridge heaters 117 made of a material having a high electrical resistance which, when energized by an electrical circuit (not shown), generate heat and keep the leg 105 within the temperature range discussed above. The adaptor 104 is preferably made of material having good thermal conductivity and has sufficient mass to facilitate an even temperature distribution throughout the leg 105.

Confronting surfaces 118, 125 of the leg 105 and the head 100, respectively, each have a corresponding key 119, 121 on which the air attenuation assembly 4 can be mounted.

The attenuating assembly 4 includes a generally cylindrical hollow manifold 120 which includes generally rectangular keyways 122 and 124 on opposite end surfaces thereof for receiving the keys 119, 121 to mount the manifold 120 between the confronting surfaces 118, 125. The manifold 120 is aligned coaxially with the axis 90 of the orifice 108 and the orifice body 84. The axial length of the manifold 120 is slightly less than the distance between the confronting surfaces of adapter leg 105 and the head 100 so that the manifold 120 may slide laterally into position therebetween. Suitable means may be connected to the air manifold 120 to move it laterally into and out of coaxial position with respect to the axis 90. Within the manifold 120 is a plenum chamber 126 into which a pressurized attenuating gas (preferably ambient air) is supplied through a coupling 128 from the supply thereof.

Figure 7:
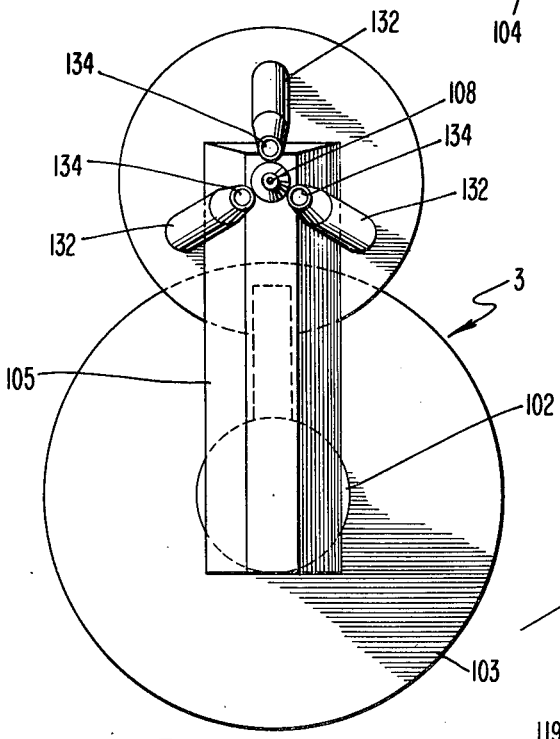
FIG. 7 is a front elevational view of the nozzle and attenuating assembly shown in FIG. 5.

Extending from the forward facing surface 130 of the manifold 120 are three gas conduits 132 (see FIG. 7) each of which communicate with the plenum chamber 126 (see FIG. 6). Each conduit 132 provides a jet of attenuating gas in the vicinity of nozzle orifice 108. The gas conduits 132 are preferably made of a reasonably stiff material such as stainless steel. The discharge opening 134 of each conduit 132 is is positioned in a plane perpendicular to the axis 90 (see FIG. 6) of nozzle orifice 108. In addition, the discharge openings 134 are preferably equiangularly disposed at a common radius from the axis 90 of the orifice 108. The conduits 132 are oriented to provide gas jets which converge upon the axis 90 of orifice 108 at an angle such as that described above in connection with the first embodiment. In addition, the gas jets intersect each other as well as the filament at the point 80.

As with the first embodiment, a minimum of three gas tubes 132 are required to provide balanced flow. Any number greater than three conduits 132 may be used so long as the discharge openings are angularly spaced at a fixed radial distance from the orifice axis to provide a balanced flow.

In operation, the operation of the second embodiment is similar to that of the first embodiment. A quantity of molten polymeric material enters the nozzle assembly 3 through the converging section 107 of the nozzle passage in the head 100 and proceeds through the cylindrical portion 106 past the bends 109 and 111 to the nozzle body 84 where it is shaped by the extrusion orifice 108 into a substantially continuous filament. Pressurized attenuating gas enters the intake 128, circulates in the plenum chamber 126, enters each of the gas conduits 132 and exhausts from the corresponding discharge opening 134 as a plurality of equiangularly spaced gas jets in front of the extrusion orifice 108. The jets intersect each other at a point 80 on axis 90. As the filament generally follows the axis 90, the gas jets also impinge upon the freshly extruded filament. The filament is then attenuated and conveyed to a collection surface as described in connection with the first embodiment.

Figure 9:
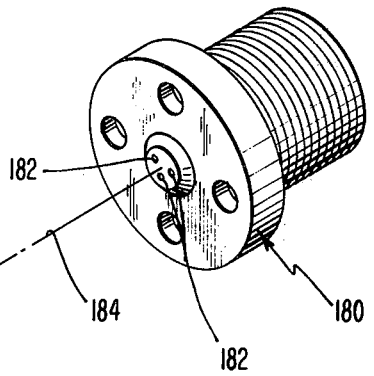
FIG. 9 is an enlarged view of an orifice body for producing several filaments.

Turning briefly to FIG. 9, an orifice body 180 is disclosed which is similar to the orifice body discussed above in connection with the first embodiment. The orifice body 180 may be used in combination with the nozzle system of the first embodiment and includes three extrusion orifices 182 so that a plurality of filaments may be simultaneously emitted. The orifices 182 are preferably positioned at a common radius from the axis 184 and are preferably equiangularly spaced to achieve uniform fluid properties in the melt as it advances therethrough.

Because the nozzle attenuating system of the present invention is well protected against nozzle freeze-up, it is possible to operate with a smaller polymeric material throughput rate and thus produce a finer filament. The nozzle assembly includes a removable orifice to facilitate quick replacement should it be necessary. The gas attenuation assembly moves laterally of the nozzle assembly to further facilitate quick access to an obstructed or malfunctioning nozzle orifice. Fast removal of the gas attenuation assembly permits filament collection to be quickly interrupted because, when the attenuation assembly is removed, the filament will tend to drop so as not to impinge upon the collection surface.

Furthermore, because the present apparatus is able to use smaller throughput rates and provide a thinner filament, the attenuation efficiency is higher and the pressure of the attenuating gas is correspondingly lower so that a smaller amount of gas is used. This has a further benefit of permitting the collection surface to be placed close to the nozzle orifice. Moreover, there is no need to adjust the angle of the attenuating gas stream to accommodate different gas pressures.

The spray spinning nozzle according to the present invention has the further advantage of providing a comparatively well focused spray pattern when compared to prior art devices. This pattern results from the enhanced directional control which the gas attenuation system provides for the filament.

In addition, the gas attenuation assembly produces a nonwoven product having superior strength in comparison to the prior art. The strength results from improved bonding of the filament with itself in the nonwoven product. This bonding improvement may result from less cooling of the filament during attenuation by virtue of the improved spray pattern definition.

It will be understood that the particular apparatus described in these preferred embodiments of the invention are susceptible of considerable modification without departing from the inventive concept herein disclosed. Consequently, it is not intended that this invention be limited to the precise details disclosed but only as set forth in the following claims.

What is claimed is:

1. A spray spinning nozzle for producing a substantially continuous filament from molten synthetic resinous polymeric material comprising:

nozzle means for receiving the material under pressure from a source of molten material, having a distal end with an opening therein and a fluid passage therethrough;

shaping means for forming a filament from the material, removably connected at the opening in fluid communication with the fluid passage and having an axis and an extrusion orifice; and, attenuation means for supplying gaseous jets angularly spaced about the axis, each jet converging on the axis at the same point, the attenuation means being laterally movable into and out of operative position with respect to the shaping means and including:

at least three conduits, each having an exhaust opening, being aligned to direct a gaseous jet at an angle to the center line, and the exhaust openings being angularly spaced about the axis; and, manifold means for supplying pressurized gas to the three conduits, having the three conduits connected thereto and extending so that the exhaust openings are downstream of the shaping means.

2. The spray spinning nozzle of claim 1 wherein each conduit has an S-shaped configuration so that the exhaust openings can be axially adjacent the shaping means.

3. The spray spinning nozzle of claim 2 wherein:

the nozzle means has a longitudinal axis coaxial with the axis of the shaping means; and, the manifold has a C-shaped configuration adapted to move into a saddle-like relation with the nozzle means so that the exhaust openings are spaced at a uniform distance from the shaping means.

4. The spray spinning nozzle of claim 3 wherein:

the opening of the nozzle means is positioned in a cylindrical recess at the distal end thereof; and, the shaping means includes a cylindrical end portion having a diameter less than the diameter of the cylindrical recess so as to define a circumscribing annular recess which reduces heat transfer therefrom.

5. The spray spinning nozzle of claim 1 wherein the nozzle means includes an angled adapter having the opening at the distal end thereof to offset the shaping means from an inlet to the fluid passage.

6. The spray spinning nozzle of claim 5, wherein:

the manifold means includes a generally cylindrical chamber positioned on one side of the adapter distal end; and, the conduits extend transversely around the distal end to position the discharge openings downstream of the opening, the conduits being spaced to receive the distal end therebetween.

7. The spray spinning nozzle of claim 6, wherein:

the adapter includes a key on the distal end adjacent the manifold means; and, the manifold means include a slot adjacent the key, adapted to receive the key and cooperating therewith to rotationally position the manifold means.

8. The spray spinning nozzle of claim 1, wherein the shaping means includes a plurality of orifices equidistant from the axis and equiangularly spaced therearound so that a corresponding plurality of filaments can be simultaneously produced.

9. The spray spinning nozzle of claim 1, wherein the shaping means is removably connected to the nozzle means so that only the shaping means need be replaced if the extrusion orifice becomes blocked.

10. In a spray spinning apparatus having a source of molten synthetic resinous polymeric material, a source of gaseous fluid and means for collecting a substantially continuous filament broadcast thereat by a nozzle, an improved spray spinning nozzle comprising:

nozzle means for receiving the material under pressure from the source of molten synthetic resinous material, having a distal end with an opening therein and a fluid passage therethrough;

shaping means for forming a filament from molten fiber-forming material, removably connected at the opening in fluid communication with the fluid passage and having an axis and an extrusion orifice; and, attenuation means for supplying gaseous jets equiangularly spaced about the axis, each jet converging on the axis at the same point, the attenuating means including:

at least three S-shaped conduits, each having an exhaust opening, being aligned to direct a gaseous jet at the centerline, and the exhaust openings being equiangularly spaced at a common radius about the axis, and C-shaped manifold means for supplying pressurized gas to the three conduits from the source of gaseous fluid, having the three conduits cantilevered therefrom and extending so that the exhaust openings define a plane perpendicular to the axis, the plane being downstream of the shaping means, and the manifold means being laterally movable into and out of operative position with respect to the shaping means.

* * * * *